US005950519A

United States Patent [19]

Anatoli

[11] Patent Number: 5,950,519

[45] Date of Patent: Sep. 14, 1999

[54] HYDRAULIC SYSTEM WITH SECONDARY EXHAUST PASSAGE

[75] Inventor: D. Li Anatoli, Changwon, Rep. of Korea

[73] Assignee: Volvo Construction Equipment Korea Co., Ltd., Rep. of Korea

[21] Appl. No.: 08/891,264

[22] Filed: Jul. 10, 1997

[30] Foreign Application Priority Data

Nov. 26, 1996 [KR] Rep. of Korea ..... P96-57784

[51] Int. Cl.[6] ..... F15B 11/08; F15B 13/04

[52] U.S. Cl. ..... 91/450; 91/457

[58] Field of Search ..... 91/449, 451, 457, 91/461, 462, 465, 450, 452

[56] References Cited

U.S. PATENT DOCUMENTS

| | | | |
|---|---|---|---|
| 37,186 | 12/1862 | Walters | 91/451 X |
| 3,125,324 | 3/1964 | Vivier | 91/452 X |
| 3,213,762 | 10/1965 | Dubuf | 91/451 |
| 3,411,416 | 11/1968 | Herd et al. | 91/451 |
| 3,771,422 | 11/1973 | Kamman | 91/451 X |
| 4,206,688 | 6/1980 | Haak et al. | 91/461 X |
| 4,611,528 | 9/1986 | Nanda et al. | 91/461 X |
| 5,097,746 | 3/1992 | Asaoka et al. | 91/461 |
| 5,235,809 | 8/1993 | Farrell | 91/461 X |
| 5,331,882 | 7/1994 | Miller | 91/461 |

*Primary Examiner*—John E. Ryznic
*Attorney, Agent, or Firm*—Harness, Dickey & Pierce, P.L.C.

[57] ABSTRACT

A hydraulic system for working cylinders of construction equipment is disclosed. The system allows oil to be smoothly drained from a chamber of a working cylinder into an oil tank through a first passage or/and a second passage without being resisted during an operation of the cylinder. The system thus effectively and smoothly moves the working cylinder while improving operational efficiency and operational speed of the cylinder. When the system is used with a boom cylinder of a power excavator, the system effectively performs a boom-up or boom-down action without losing pressure.

4 Claims, 4 Drawing Sheets

HYDRAULIC SYSTEM WITH SECONDARY EXHAUST PASSAGE

BACKGROUND OF THE INVENTION

1. Field of the Invention

The present invention relates, in general, to a hydraulic system for construction equipment such as power excavators or power loaders and, more particularly, to a hydraulic system used for effectively operating working cylinders or cylinder actuators associated with working units, such as a boom or a bucket, of such construction equipment.

2. Description of the Prior Art

FIG. 1 shows the construction of a typical hydraulic system for working cylinders of construction equipment, for example, a power excavator which is used for excavating and loading bulk materials, such as sand and pebbles.

As shown in the drawing, the hydraulic system has an oil pump P and a working cylinder A. The working cylinder A is, for example, a boom cylinder of the power excavator and is operated by pressurized oil discharged from the pump P. A directional control valve C is mounted to an oil passage extending from the pump P to the boom cylinder A and has a spool, which is movable in either direction in response to a pilot signal PiA, PiB thus controlling the pump discharged oil (pressurized oil) for the boom cylinder A. When the control valve C is positioned at its neutral position, the pump discharged oil is drained into an oil tank T through a bypass line L1. Meanwhile, when the valve C is switched from the neutral position into a first or second position I or II in response to a pilot signal PiA, PiB, the pump discharged oil passes through an oil passage L3, L4 and is introduced into the large or small chamber of the boom cylinder A so that the cylinder A moves the boom of the excavator up or down. When the control valve C is positioned at the first position I in response to the pilot signal PiB, the pump discharged oil is fed into the large chamber of the boom cylinder A through the oil passage L3, with the pressurized oil of the small chamber of the cylinder A being drained into the tank T through the oil passages L4 and L2. Meanwhile, when the control valve C is positioned at the second position II in response to the pilot signal PiA, the pump discharged oil is fed into the small chamber of the boom cylinder A through the oil passage L4, with the pressurized oil of the large chamber of the cylinder A being drained into the tank T through the oil passages L3 and L2. The above-mentioned operation of the system is well known from the construction of the internal passage of the system shown in FIG. 1. The boom cylinder of a power excavator performs a boom-up action when the pump discharged oil is fed into the large chamber of the cylinder and performs a boom-down action when the pump discharged oil is fed into the small chamber of the cylinder.

A relief valve R is mounted to a return passage L5, which extends from both the pump P and the boom cylinder A to the oil tank T. The relief valve R is for maintaining a desirable preset pressure of the system.

However, the above hydraulic system is problematic in that the relief valve R acts as a load in the system when the pressurized oil is drained from the boom cylinder A into the tank T through the return line L2, which prevents the smooth returning of oil into the oil tank T. Therefore, the system causes pressure loss and reduces both operational efficiency and operational speed of the working cylinder or the boom cylinder.

In an effort to overcome the above problem, a hydraulic system for working cylinders shown in FIG. 2 is proposed.

In the hydraulic system of FIG. 2, two return passages L6 and L6 extend from the large and small chambers of a boom cylinder A to an oil tank T, respectively in order to relieve the load caused by the relief valve R. Passage control valve 101, 102 are mounted to each of the two return passages L6 and L7. The system also has a selector valve 103, 104, which is operated in response to a pilot signal PiA, PiB applied to the spool of a directional control valve C and selectively controls each of the two passage control valves 101 and 102. When the pilot signal or pilot pressure PiB is applied onto the spool of the valve C, the pump discharged oil is fed into the large chamber of the boom cylinder A through the oil passage L3 thus causing a boom-up action. The pilot pressure PiB also acts on the back pressure part (closing the passage upon being pressurized) of each of the selector valves 103 and 104 so that the oil passage within the valve 103, 104 is closed by the selector valve 103, 104, with the passage control valve 101, 102 closing the return passage L6, L7 by its valve spring. The hydraulic system in the above state performs the same operation as that described for the system of FIG. 1.

Meanwhile, when the pilot signal or pilot pressure PiA is applied onto the spool of the valve C, the pump discharged oil is fed into the small chamber of the boom cylinder A through the oil passage L4 thus causing a boom-down action. The pilot pressure PiA also acts on the pressure receiving part (opening the passage upon being pressurized) of each of the selector valves 103 and 104 so that the oil passage within the selector valve 103, 104 is opened by the selector valve 103, 104. In this case, the oil, acting on the back pressure part of each valve 101, 102 and closing the return passage L6, L7, is drained into the oil tank T through the selector valve 103, 104 so that the passage control valve 101, 102 opens the return passage L6, L7. When the return passage L6, L7 is opened as described above, the pressurized oil is discharged from the large or small chamber of the boom cylinder A into the oil tank T through not only the valve, but also through the return passage L6, L7, thus effectively preventing pressure loss and improving operational efficiency of the boom cylinder during a boom-down action since the oil from the boom cylinder is returned to the tank T through two passages L4, L5 during a boom-down action. Of course, the preset pressure of the relief valve R of the return passage L5 is lower than that of the relief valve R of FIG. 1 which relieves the load caused by the relief valve R.

As described above, the typical hydraulic system of FIG. 1 causes a pressure loss due to the preset pressure of a relief valve while the pressurized oil is drained from a working cylinder into an oil tank. The above system thus reduces operational efficiency and operational speed of the working cylinder. The system of FIG. 2, which is proposed to overcome the problem experienced in the system of FIG. 1, is problematic in that its operational effect is only expected during a boom-down operation but not during a boom-up operation since only a single passage returning the oil from the cylinder to the tank, that is the passage of the control valve, is provided.

SUMMARY OF THE INVENTION

Accordingly, the present invention has been made keeping in mind the above problems occurring in the prior art. An object of the present invention is to provide a hydraulic system for working cylinders of construction equipment, which smoothly and effectively operates a working cylinder while pressurized oil is drained from the working cylinder into an oil tank by providing two passages returning the oil from the cylinder to this tank not only during a boom-down operation, but also during a boom-up operation.

In a first embodiment of the present invention, a hydraulic system for working cylinders of construction equipment is provided. The hydraulic system includes an oil pump discharging pressurized oil and at least one working cylinder operated by the pump discharged oil. A directional control valve for providing pump discharged oil to the cylinder. The hydraulic system further comprises a first oil passage connecting a large chamber of the cylinder to an oil tank. The first oil passage is separate from the directional control valve. Similarly, a second oil passage is provided connecting a small chamber of the cylinder to the oil tank. The second oil passage is separate from the directional control valve. A first passage control valve is disposed within the first oil passage and is adapted for normally closing the first oil passage. The first passage control valve opens the first oil passage when the pump discharged oil is fed into the small chamber of the cylinder by the directional control valve. A second passage control valve is disposed within the second oil passage and is adapted for normally closing the second oil passage. The second passage control valve opens the second oil passage when the pump discharged oil is fed into the large chamber of the cylinder by the directional control valve. The present invention provides a separate return passage for both the boom-up operation and the boom-down operation to improve the operational efficiency of the hydraulic system.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 3:
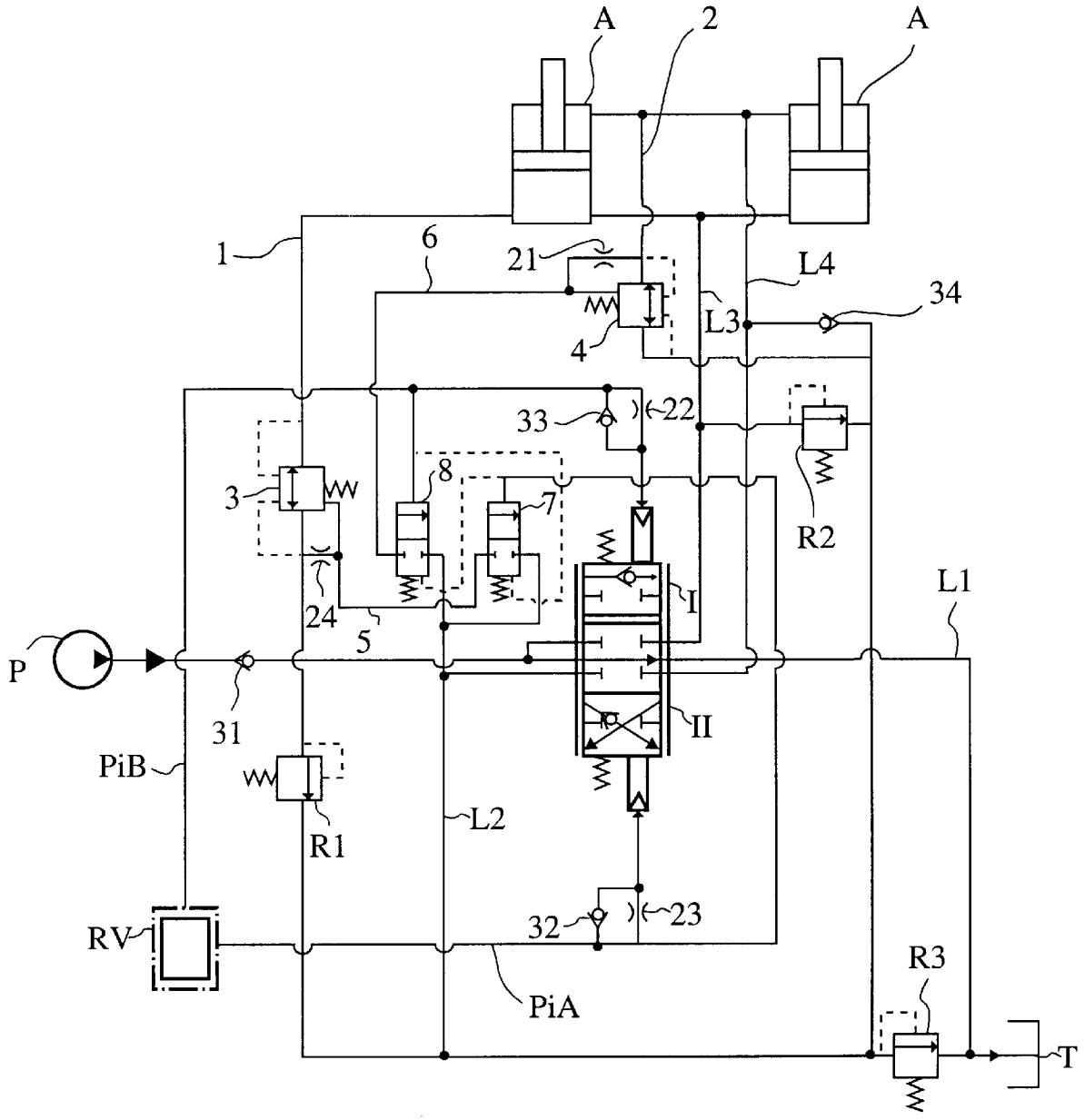
FIG. 3 is a diagram showing the construction of a hydraulic system for working cylinders of construction equipment in accordance with the primary embodiment of the present invention.

FIG. 3 is a diagram showing the construction of a hydraulic system for working cylinders of construction equipment in accordance with the primary embodiment of the present invention. In the system of this invention, the same members as those in the prior art system are denoted by the same reference numerals as those in the prior art system and description thereof is omitted.

The system of FIG. 3 has an oil pump P and at least one working cylinder A. The working cylinder A is, for example, a boom cylinder and is operated by pressurized oil discharged from the pump P. A directional control valve C is mounted to an oil passage extending from the pump P to the boom cylinder A and has a spool, which is movable in either direction in response to a pilot signal PiA, PiB thus controlling the pump discharged oil for the boom cylinder A. When the control valve C is positioned at its neutral position, the pump discharged oil (pressurized oil) is drained into an oil tank T through a center bypass line L1. Meanwhile, when the control valve C is switched from the neutral position into a first or second position I or II in response to a pilot signal PiA, PiB, the pump discharged oil passes through an oil passage L3, L4 and is introduced into the large or small chamber of the boom cylinder A, thus operating the cylinder A and causing the cylinder A to actuate the boom.

In the above system, a first oil passage 1 connects the large chamber of the cylinder A to the oil tank T, while a second oil passage 2 connects the small chamber of the cylinder A to the oil tank T. A first passage control valve 3 is mounted to the first passage 1, while a second passage control valve 4 is mounted to the second passage 2. The first passage control valve 3 normally closes the first passage 1 by the spring force of its valve spring and selectively opens the passage 1 when the pump discharged oil is fed into the small chamber of the cylinder A under the control of the directional control valve C. Meanwhile, the second passage control valve 4 normally closes the second passage 2 by the spring force of its valve spring and selectively opens the second passage 2 when the pump discharged oil is fed into the large chamber of the cylinder A under the control of the valve C.

In detail, a third passage 5 extends from the back pressure part (closing the first passage 1 when pressurized) of the first passage control valve 3 to the oil tank T. In addition, fourth passage 6 extends from the back pressure part (closing the second passage 2 upon being pressurized) of the second passage control valve 4 to the oil tank T. The system also has two selector valves 7 and 8, which are mounted to the two passages 5 and 6 respectively. Each of the selector valves 7 and 8 is operated in response to a pilot pressure PiA, PiB in order to selectively open an associated passage 5, 6. That is, each of the selector valves 7 and 8 normally closes associated passages 5, 6 by the spring force of its valve spring and is selectively open the passage 5, 6 in response to pilot pressure PiA, PiB acting on the valve spring. When the third passage 5 is opened by the first selector valve 7, the pressure acting on the back pressure part of the first passage control valve 3 is removed, thus causing the valve 3 to open the first passage 1. Meanwhile, when the fourth passage 6 is opened by the second selector valve 8, the pressure acting on the back pressure part of the second passage control valve 4 is removed thus causing the valve 4 to open the second passage 2.

The pilot pressures PiA and PiB for the selector valves 7 and 8 are applied to the valves 7 and 8 in the following manner.

The pilot pressure PiA, which brings the position of the control valve C into the second position II and causes the pump discharged oil to be fed into the small chamber of the cylinder A, is applied from the remote control valve RV through a first pilot pressure line. The first pilot pressure line extends from the remote control valve RV and connects the pressure receiving part (opening the third passage 5 when pressurized) of the first selector valve 7 and also to the back pressure part (closing the fourth passage 6 when pressurized) of the second selector valve 8. That is, when the pilot pressure PiA from the remote control valve RV is applied to the directional control valve C through the first pilot pressure line, the pilot pressure PiA moves the spool of the valve C into the second position II. The pilot pressure PiA in the above state also acts on the pressure receiving part of the first selector valve 7 thus opening the third passage 5, causing the first passage control valve 3 to open the first passage 1. Therefore, the oil of the large chamber of the cylinder A is drained into the oil tank T not only through the valve C but also through the first passage 1. This means that the oil of the large chamber of the cylinder A is smoothly drained into the tank T with less resistance, thus causing a smooth boom-down action.

Meanwhile, the pilot pressure PiB, which brings the position of the control valve C into the first position I and causes the pump discharged oil to be fed into the large chamber of the cylinder A, is applied from the remote control valve RV through a second pilot pressure line. The second pilot pressure line extends from the remote control valve RV and connects the pressure receiving part (opening the fourth passage 6 upon being pressurized) of the second selector valve 8 to the back pressure part (closing the third passage 5 upon being pressurized) of the first selector valve 7. That is, when the pilot pressure PiB from the remote control valve RV is applied onto the directional control valve C through the second pilot pressure line, the pilot pressure PiB moves the spool of the valve C into the first position I. The pilot pressure PiB in the above state also acts on the pressure receiving part of the second selector valve 8 thus opening the fourth passage 6 and causing the second passage control valve 4 to open the second passage 2. Therefore, the oil of the small chamber of the cylinder A is drained into the oil tank T not only through the valve C but also through the second passage 2. This means that the oil of the small chamber of the cylinder A is smoothly drained into the tank T with less resistance, thus causing a smooth boom-down action.

Figure 1:
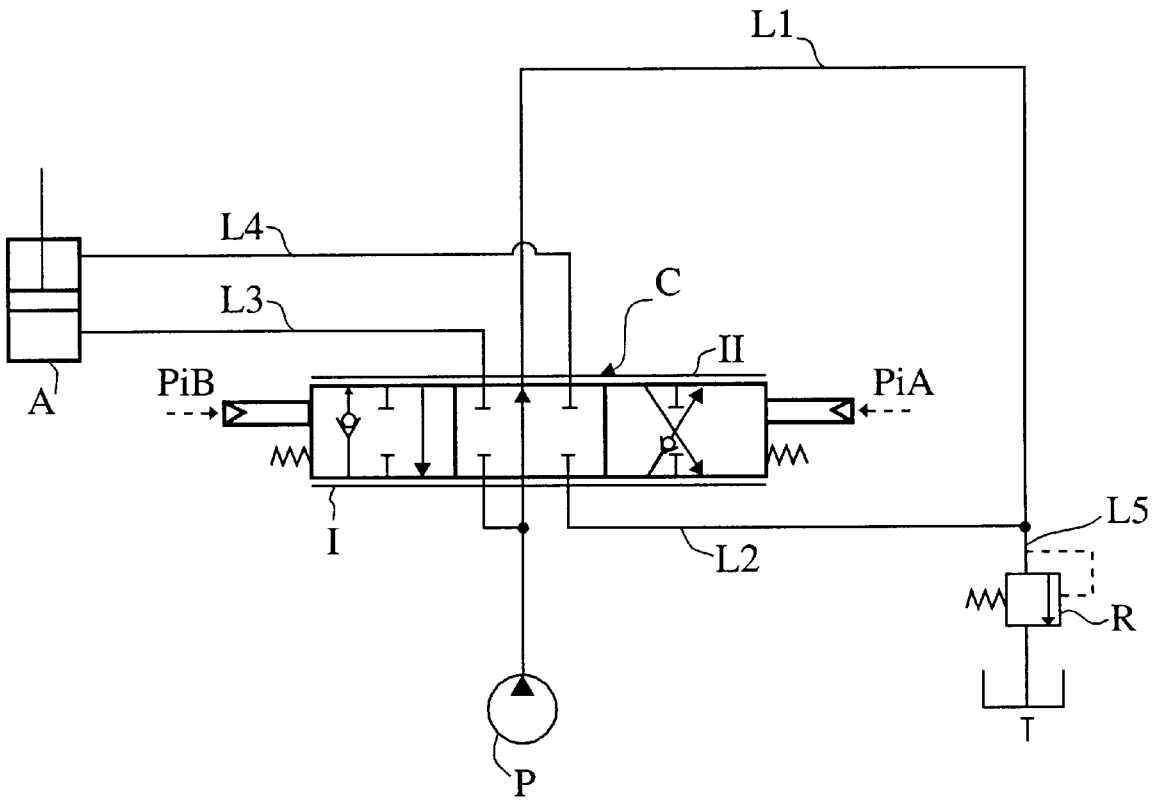
FIG. 1 PRIOR ART
FIG. 1 is a diagram showing the construction of a typical hydraulic system for working cylinders of construction equipment.
Figure 2:
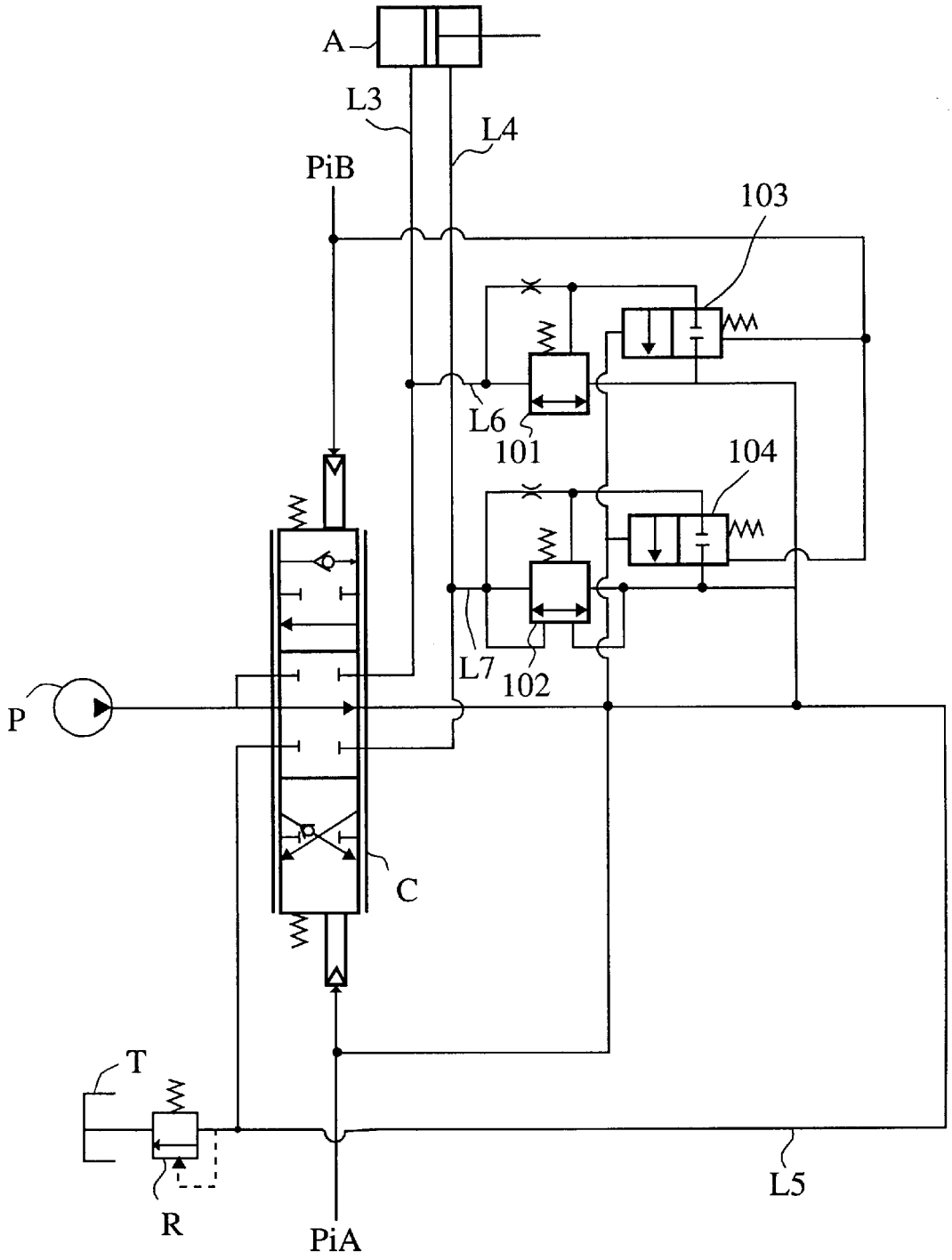
FIG. 2 PRIOR ART
FIG. 2 is a diagram showing the construction of a typical hydraulic system with an improved operational effect in accordance with another embodiment of the prior art.

It should be appreciated by one skilled in the art that by draining the oil of cylinder A through both control valve C and passage 1 or 2, relief valve R3 may have a lower preset pressure relative to relief valve R of FIG. 1 or 2.

In FIG. 3, the reference numeral R2 denotes a relief valve, the numerals 21, 22, 23 and 24 individually denote an orifice, and the numerals 31, 32, 33 and 34 individually denotes a check valve.

Figure 4:
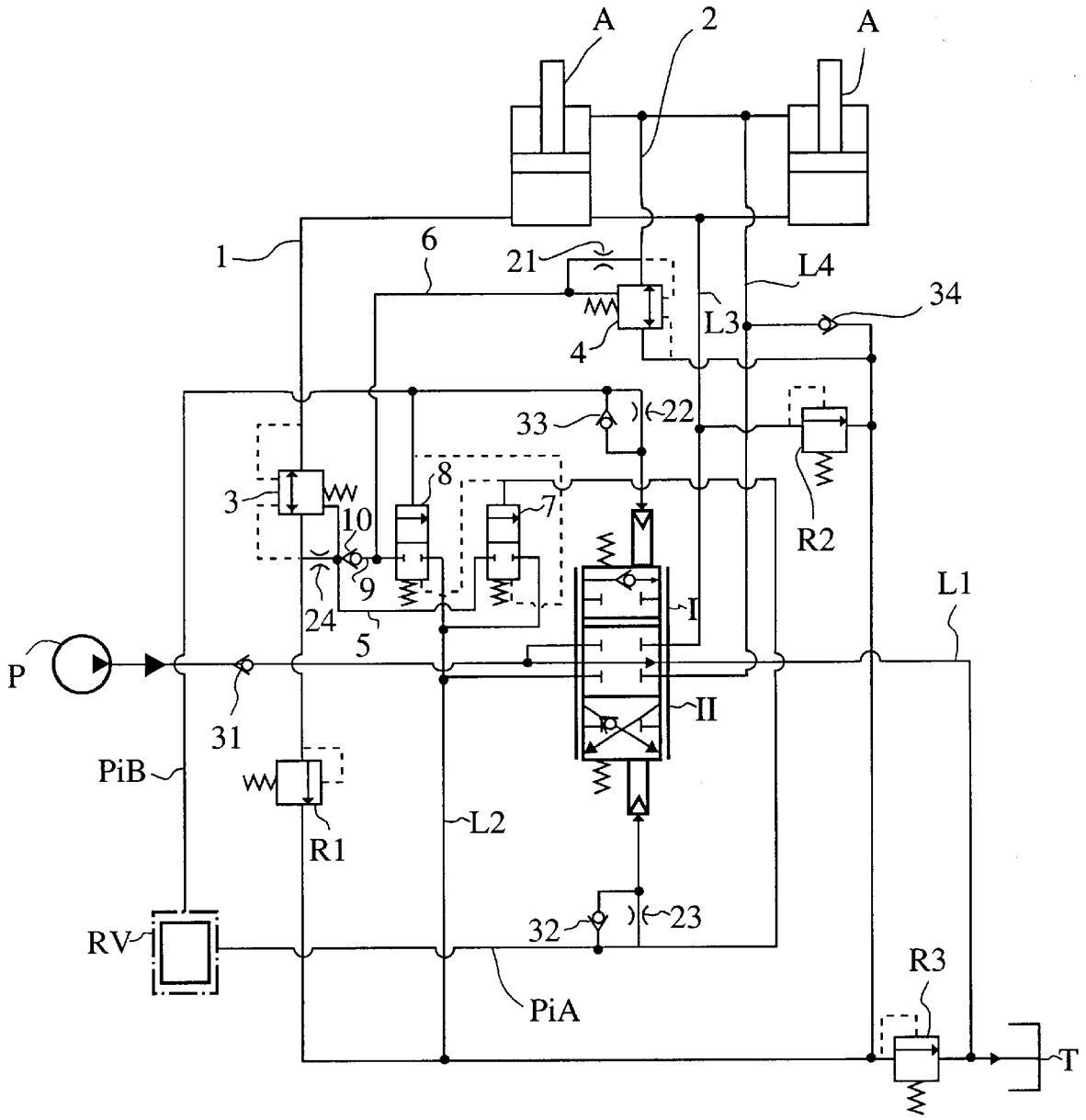
FIG. 4 is a diagram showing the construction of a hydraulic system in accordance with another embodiment of the present invention.

FIG. 4 is a diagram showing the construction of a hydraulic system in accordance with the second embodiment of the present invention.

In the second embodiment, the general shape of the system remains the same as in the primary embodiment of FIG. 3, but the passages 5 and 6 are connected together by an interconnection passage 9 with a check valve 10. The check valve 10 only allows the oil to flow in a direction from the third passage 5 to the fourth passage 6. In the above system, when the second selector valve 8 opens the fourth passage 6 in response to the pilot pressure PiB, the pressurized oil acting on the back pressure part of the second passage control valve 4 is drained into the tank T through the fourth passage 6, thus opening the second passage 2. In this case, the pressurized oil acting on the back pressure part of the first passage control valve 3 is also drained into the tank T through the interconnection passage 9, the check valve 10 and the passage 6, thus opening the first passage 1. Therefore, when the pump discharged oil is fed into the large chamber of the cylinder A and causes a boom-up action, the two passage control valves 3 and 4 open their associated passages 1 and 2, thus accomplishing a smooth boom-up action. Meanwhile, when the pump discharged oil is fed into the small chamber of the cylinder A and causes a boom-down action, the selector valve 7 opens the third passage 5 and causes the back pressure part of the passage control valve 3 to be free from pressure. In the above state, the first passage 1 is opened by the passage control valve 3, while the second passage 2 is closed in the same manner as that described for the primary embodiment.

As described above, the present invention provides a hydraulic system for working cylinders of construction equipment. The system effectively and smoothly moves a working cylinder, for example, a boom cylinder of a power excavator, in either direction and causes a boom-up or boom-down action without losing pressure, thus improving the operational effect of the construction equipment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hydraulic system for working cylinders of construction equipment, comprising an oil pump, at least one working cylinder operated by pump discharged oil, and a directional control valve for providing the oil to said cylinder and returning the oil to an oil tank, further comprising:

a first oil passage connecting a large chamber of said cylinder to the oil tank, said first oil passage being provided separately from the directional control valve;

a second oil passage connecting a small chamber of said cylinder to the oil tank, said second oil passage being provided separately from the directional control valve;

a first passage control valve disposed within said first oil passage, said first passage control valve opening the first oil passage when the pump discharged oil is fed into the small chamber of the cylinder through the directional valve but otherwise closing the first passage control valve; and a second passage control valve disposed within said second oil passage, said second passage control valve opening the second oil passage when the pump discharged oil is fed into the large chamber of the cylinder through the directional valve but otherwise closing the second passage control valve.

2. The hydraulic system according to claim 1, further comprising:

a third oil passage connecting a back pressure part of said first passage control valve to the oil tank;

a fourth oil passage connecting a back pressure part of said second passage control valve to the oil tank;

a first selector valve mounted to said third oil passage and adapted for normally closing and selectively opening the third oil passage in response to a pilot pressure thus causing the first passage control valve to open the first oil passage; and a second selector valve mounted to said fourth oil passage and adapted for normally closing and selectively opening the fourth oil passage in response to a pilot pressure thus causing the second passage control valve to open the second oil passage.

3. The hydraulic system according to claim 2, wherein said pilot pressure for the first selector valve is branched from a pilot pressure moving the spool of the direction control valve in a direction causing the pump discharged oil to be fed into the small chamber of the cylinder; and said pilot pressure for the second selector valve is branched from a pilot pressure moving the spool of the direction control valve in the other direction causing the pump discharged oil to be fed into the large chamber of the cylinder.

4. The hydraulic system according to claim 2, further comprising:

an interconnection passage connecting the third and fourth oil passages together; and a check valve mounted to said interconnection passage and adapted for allowing the oil to exclusively flow from the third oil passage to the fourth oil passage, thus opening both the first and second oil passages when the pump discharged oil is fed into the large chamber of the cylinder and opening only the first oil passage when the pump discharged oil is fed into the small chamber of the cylinder.

* * * * *